US007704931B2

(12) United States Patent
Dong et al.

(10) Patent No.: US 7,704,931 B2
(45) Date of Patent: Apr. 27, 2010

(54) LUBRICANT COMPOSITIONS STABILIZED WITH MULTIPLE ANTIOXIDANTS

(75) Inventors: Jun Dong, Waterbury, CT (US); Cyril A. Migdal, Pleasant Valley, NY (US)

(73) Assignee: Chemtura Corporation, Middlebury, CT (US)

( * ) Notice: Subject to any disclaimer, the term of this patent is extended or adjusted under 35 U.S.C. 154(b) by 902 days.

(21) Appl. No.: 11/145,493

(22) Filed: Jun. 3, 2005

(65) Prior Publication Data

US 2006/0128574 A1 Jun. 15, 2006

Related U.S. Application Data

(60) Provisional application No. 60/634,535, filed on Dec. 10, 2004.

(51) Int. Cl.

| | |
|---|---|
| ***C10M 133/12*** | (2006.01) |
| ***C09K 15/08*** | (2006.01) |
| ***C10L 1/22*** | (2006.01) |
| ***C10L 1/18*** | (2006.01) |

(52) U.S. Cl. ..... 508/557; 508/563; 508/584; 44/426; 44/430; 44/450

(58) Field of Classification Search ..... None
See application file for complete search history.

(56) References Cited

U.S. PATENT DOCUMENTS

| | | | | |
|---|---|---|---|---|
| 2,451,642 | A | 10/1948 | Watson | 252/50 |
| 2,718,501 | A | 9/1955 | Harle | 252/47 |
| 3,062,895 | A | 11/1962 | Martin et al. | |
| 5,232,614 | A | 8/1993 | Colclough et al. | 252/32.7 |
| 5,498,809 | A | 3/1996 | Emert et al. | 585/13 |
| 2002/0151443 | A1 * | 10/2002 | Srinivasan | 508/273 |
| 2004/0148850 | A1 * | 8/2004 | O'Rear et al. | 44/426 |
| 2004/0204326 | A1 * | 10/2004 | Costello et al. | 508/545 |
| 2004/0211113 | A1 * | 10/2004 | Duyck et al. | 44/426 |

FOREIGN PATENT DOCUMENTS

| | | | |
|---|---|---|---|
| EP | 1006173 | | 6/2000 |
| EP | 1054052 | A2 * | 11/2000 |
| GB | 2146657 | | 4/1984 |
| IN | 151316 | | 3/1983 |
| JP | 53051206 | | 5/1978 |
| JP | 56084794 | | 7/1981 |
| JP | 58174494 | | 10/1983 |
| JP | 59020392 | | 2/1984 |
| PL | 149256 | | 1/1990 |
| PL | 154393 | | 8/1991 |
| SU | 1155615 | | 5/1985 |
| WO | 94/22988 | | 3/1994 |
| WO | WO 9422988 | | 10/1994 |

* cited by examiner

*Primary Examiner*—Glenn A Caldarola
*Assistant Examiner*—Vishal Vasisth
(74) *Attorney, Agent, or Firm*—Joann Villamizar

(57) ABSTRACT

A lubricant composition is disclosed that comprises lubricating oil and a mixture of at least two antioxidants, the first antioxidant being a secondary diarylamine and the second antioxidant being a substituted para-phenylenediamine. Also disclosed is a method of increasing the oxidation stability of a lubricating oil comprising adding thereto at least two antioxidants, the first antioxidant being a secondary diarylamine and the second antioxidant being a substituted para-phenylenediamine.

6 Claims, No Drawings

LUBRICANT COMPOSITIONS STABILIZED WITH MULTIPLE ANTIOXIDANTS

We claim the benefit under Title 35, United States Code, §120 to U.S. Provisional Application No. 60/634,535, filed Dec. 10, 2004, entitled LUBRICANT COMPOSITIONS STABILIZED WITH MULTIPLE ANTIOXIDANTS

BACKGROUND OF THE INVENTION

1. Field of the Invention

The present invention relates to improving the oxidation stability of lubricants, especially hydrocarbon based lubricating oils, by adding thereto a combination of a secondary diarylamine and a substituted para-phenylenediamine.

2. Description of Related Art

Lubricants, such as those used in a variety of machinery, are susceptible to oxidative deterioration during storage, transportation, and usage, particularly when such lubricants are exposed to high temperatures and iron catalytic environments, which greatly promote their oxidation. This oxidation, if not controlled, contributes to the formation of corrosive acidic products, sludge, varnishes, resins, and other oil-insoluble products, and may lead to a loss of designated physical and tribological properties of the lubricants. It is therefore a common practice to include an antioxidant in lubricants to prevent, at least to some extent, oxidation, so as to extend their useful life. Lubricant compositions containing various secondary diarylamines as antioxidants are widely known in the art. The use of para-phenylenediamines is also known, although to a lesser extent.

U.S. Pat. No. 2,451,642 discloses para-phenylenediamines as useful antioxidants for lubricating oil compositions for use in environments where iron-catalyzed oxidation reaction can take place.

U.S. Pat. No. 2,718,501 discloses a stabilizer system consisting of an aromatic amine with at least two aromatic rings, including para-phenylenediamine, and an organic aliphatic sulfur compound, which is said to be suitable for stabilizing mineral hydrocarbon lubricating oils, synthetic hydrocarbon oils, and polyalkylene glycol oils.

U.S. Pat. No. 5,232,614 discloses substituted para-phenylene diamines that are said to be effective antioxidants capable of protecting crankcase lubricating oils from thickening and sludge formation after prolonged exposure to oxygen at elevated temperature.

WO 94/22988 discloses a fuel composition said to improve the antiwear and viscosity controlling properties of an internal combustion engine lubricating oil during operation of the engine. Small amounts of the fuel composition combine with the engine lubricating oil during engine operation and this provides an antioxidant boost to the lubricating oil. Preferably the fuel contains at least 57 g/1000 liters of a substituted dicyclic aromatic amine which is free of benzylic hydrogen atoms such as a mono- and/or di-α-methyl styrene alkylated phenylenediamine and/or a hindered phenol such as a monostyrenated mono-isobutenated cresol or di $C_{16}$ alkyl phenol. A synergistic effect is said to be demonstrated by a mixture of the aromatic amine and hindered phenol.

IN 151,316 discloses the use of N,N'-di-sec-butyl-p-phenylenediamine as antioxidant for a solvent extracted, dewaxed and hydrofinished mineral oil based lubricating oil composition for heavy duty air compressors.

JP 53,051,206 discloses N,N'-2-naphthyl-p-phenylenediamine as an antioxidant to improve the oxidation stabilities of ester or mineral oil based lubricating oils that also contain disulfides.

JP 59,020,392 discloses a lubricant composition comprising N,N'-di-sec-butyl-p-phenylenediamine for pressure forming of oil tanks. The lubricant composition also contains hindered phenolic antioxidant.

Polish PL 149,256 discloses the use of phenyl-naphthyl-para-phenylene diamine for polyalkylene glycol based fire resistant hydraulic fluids.

Soviet Union Patent 1,155,615 discloses a mineral oil and cephalins based lubricant composition comprising diphenyl-para-phenylenediamine for cold deformation of metals.

The foregoing disclosures are incorporated herein by reference in their entirety.

Heretofore, there has been no recognition of the use of secondary diarylamines in a particular combination with substituted para-phenylenediamine that provides unexpected synergistic results in stabilizing lubricants, e.g., lubricating oils, especially those intended for use in a demanding environment, such as where high temperature and metal catalyzed oxidative reactions may take place.

SUMMARY OF THE INVENTION

It has now been discovered that a combination of a secondary diarylamine and a substituted para-phenylenediamine, optionally in admixture with a substituted phenol, exhibits synergistic effects in inhibiting the oxidation of lubricant compositions and therefore is more effective than using either of the materials alone. The alkylated diarylamines act synergistically with the substituted para-phenylenediamines to provide significant improvements in oxidation control.

More particularly, the present invention is directed to a lubricant composition comprising:

(A) at least one lubricating oil selected from the group consisting of natural and synthetic lubricating base oils;

(B) at least one first antioxidant selected from the group consisting of secondary diarylamines represented by the formula $$(R_1)_a—Ar_1—NH—Ar_2—(R_2)_b \quad (I)$$

wherein $Ar_1$ and $Ar_2$ are independently selected from the group consisting of aromatic hydrocarbons, and $R_1$ and $R_2$ are independently selected from the group consisting of hydrogen and hydrocarbyl groups, preferably having from 6 to about 100 carbon atoms, and a and b are independently 0 to 3, provided that (a+b) is not greater than 4; and (C) at least one second antioxidant selected from the group consisting of substituted para-phenylenediamines of the formula

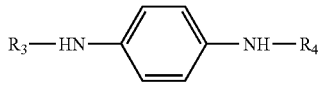

(II)

wherein $R_3$ and $R_4$ are independently selected from the group consisting of hydrogen and hydrocarbyl groups, preferably having from 1 to 100 carbon atoms; and, optionally, (D) at least one third antioxidant selected from the group consisting of substituted phenols of the formula (III)

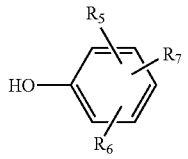

wherein $R_5$, $R_6$, and $R_7$ are independently selected from the group consisting of hydrogen and hydrocarbyl groups, preferably having 1 to 100 carbon atoms, provided that at least one hydrocarbyl group is in the ortho position and is preferably an alkyl with an iso- or tert-structure.

In another aspect, the present invention is directed to a method of increasing the oxidation stability of a lubricant comprising adding thereto at least one first antioxidant selected from the group consisting of secondary diarylamines represented by formula (I), at least one second antioxidant selected from the group consisting of substituted para-phenylenediamines represented by formula (II), and optionally, at least one third antioxidant selected from the group consisting of substituted phenols represented by formula (III).

DESCRIPTION OF THE PREFERRED EMBODIMENTS

The term "hydrocarbyl" as used herein includes hydrocarbon as well as substantially hydrocarbon groups. "Substantially hydrocarbon" describes groups that contain heteroatom substituents that do not alter the predominantly hydrocarbon nature of the group. Examples of hydrocarbyl groups include, but not limited to, the following:

(1) hydrocarbon substituents, i.e., aliphatic (e.g., alkyl or alkenyl), alicyclic (e.g., cycloalkyl, cycloalkenyl) substituents, aromatic substituents, aromatic-, aliphatic-, and alicyclic-substituted aromatic substituents, and the like, as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent—those skilled in the art will be aware of such groups (e.g., halo, hydroxy, mercapto, nitro, nitroso, sulfoxy, cyano, and the like);

(3) heteroatom substituents, i.e., substituents that will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen, and such substituents as, e.g., pyridyl, furyl, thienyl, imidazolyl, and the like. Preferably, no more than about 2, more preferably no more than one, hetero substituent will be present for every ten carbon atoms in the hydrocarbyl group. Most preferably, there will be no such heteroatom substituents in the hydrocarbyl group, i.e., the hydrocarbyl group is purely hydrocarbon.

As stated above, the secondary diarylamines used as the first antioxidant in the practice of this invention can be represented by the following formula (I):

$$(R_1)_a—Ar_1—NH—Ar_2—(R_2)_b \quad (I)$$

wherein $Ar_1$ and $Ar_2$ are independently selected aromatic hydrocarbon groups, $R_1$ and $R_2$ are independently selected hydrogen or hydrocarbyl constituents preferably having from 1 to about 100 carbon atoms, and a and b are independently selected integers of from 0 to 3, provided that (a+b) is not greater than 4.

A second antioxidant is selected from substituted para-phenylenediamines represented by formula (II):

(II)

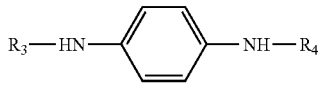

wherein $R_3$ and $R_4$ are independently selected hydrocarbyl groups preferably from having from 1 to about 100 carbon atoms.

Optionally, a third antioxidant selected from substituted phenols represented by formula (III) can also be present:

(III)

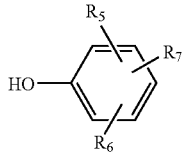

wherein $R_5$, $R_6$, and $R_7$ are independently hydrogen or hydrocarbyl groups preferably having from 1 to about 100 carbon atoms, provided that at least one hydrocarbyl group is in the ortho position and is alkyl, preferably with an iso- or tert-structure.

The preferred aryl moieties suitable for the secondary diarylamine as represented by the general formula (I) are phenyl or naphthyl. There is no particular restriction on the type and total number of carbon atoms in the hydrocarbyl groups $R_1$-$R_4$ of the secondary diarylamines and the substituted para-phenylenediames as represented by the general formulae (I)-(II) provided that the total number of carbon atoms renders sufficient thermal stability and solubility of the additives in the lubricant. Preferably, the hydrocarbyl moieties are alkyl, alkenyl, cycloalkyl, cycloalkenyl, aryl, arylalkyl, arylalkenyl, naphthyl, and napthyl substituted with alkyl and/or alkenyl groups, hydroxyl, carboxyl substituents, and the like. In general, the total number of carbon atoms in a hydrocarbyl group is preferably not less than 6 and can practically be as many as about 100. Illustrative of one embodiment of the general formulae (I) and (II) is $R_1$-$R_4$ being independently hydrocarbyl groups having from 1 to about 100 carbon atoms, and one embodiment from 1 to about 50 carbon atoms, and one embodiment from 1 to about 30 carbon atoms, provided that the total number of carbon atoms is at least 6. The following are exemplary of preferred hydrocarbyls suitable for the practice of this invention:

(a) straight chain and branched chain alkyl or alkenyl groups containing from one to about 40 carbon atoms, more preferably straight chain or branched chain alkyl groups containing from one to 20 carbon atoms, such as methyl, ethyl, propyl, butyl, pentyl, hexyl, heptyl, octyl, 2-ethyl hexyl, nonyl, decyl, undecyl, dodecyl, tridecyl, tetradecyl, pentadecyl, hexadecyl, heptadecyl, octadecyl, oleyl, nonadecyl, eicosyl, isomers and mixtures of the foregoing, and the like;

(b) cyclic alkyl and alkenyl groups, such as cyclopentyl, cyclohexyl, cycloheptyl, cyclooctyl, cyclododecyl, cyclopentenyl, cyclohexenyl, cycloheptenyl, cyclooctenyl, cyclododecenyl, cyclopentadienyl, cyclohexadienyl, cycloheptadienyl, cyclooctadienyl, and the like, optionally substituted with one or more alkyl or alkenyl radicals having from one to 40 carbon atoms, and more preferably from one to 16 carbon atoms, such as methyl, ethyl, propyl, butyl, pentyl, hexyl, heptyl, octyl, nonyl, decyl, undecyl, dodecyl, tridecyl, tetradecyl, pentadecyl, hexadecyl, isomers and mixtures of the foregoing, and the like;

(c) phenyl and phenyl substituted with one or more alkyl or alkenyl radicals having from one to 40 carbon atoms, more preferably from one to 16 carbon atoms, such as methyl, ethyl, propyl, butyl, pentyl, hexyl, heptyl, octyl, nonyl, decyl, undecyl, dodecyl, tridecyl, tetradecyl, pentadeyl, hexadecyl, isomers of the foregoing, and the like;

(d) naphthyl and naphthyl substituted with one or more alkyl or alkenyl radicals having from one to 40 carbon atoms, more preferably from one to 16 carbon atoms such as methyl, ethyl, propyl, butyl, pentyl, hexyl, heptyl, octyl, nonyl, decyl, undecyl, dodecyl, tridecyl, tetradecyl, pentadeyl, hexadecyl, isomers and mixtures of the foregoing, and the like;

(e) heteroatom substituents, particularly alkoxyalkyl, alkoxyaryl groups having from one to 40 carbon atoms, more preferably from one to 20 carbon atoms, such as methoxymethyl, ethoxymethyl, ethoxyethyl, propoxymethyl, propoxyethyl, propoxypropyl, and the like; and phenyl substituted with one or more alkoxy groups having from one to 16 carbon atoms, such as methoxy, ethoxy, propoxy, butoxy, pentoxy, hexoxy, heptoxy, octoxy, nonoxy, decoxy, undecoxy, dodecoxy, tridecyl, tetradecoxy, tetradecoxy, pentadecoxy, hexadecoxy, isomers and mixtures of the foregoing, and the like; and (f) substituted hydrocarbon substituents, particularly hydroxyl, carboxyl, nitro, cyano, and the like.

Examples of some of the secondary diarylamines represented by the general formula (I) that are useful in the practice of the present invention include diphenylamine, monoalkylated diphenylamine, dialkylated diphenylamine, trialkylated diphenylamine, or mixtures thereof, 3-hydroxydiphenylamine, 4-hydroxydiphenylamine, mono- and/or di-butyldiphenylamine, mono- and/or di-octyldiphenylamine, mono- and/or di-nonyldiphenylamine, phenyl-α-naphthylamine, phenyl-β-naphthylamine, diheptyldiphenylamine, mono- and/or di-(α-methylstyryl)diphenylamine, mono- and/or distyryldiphenylamine, 4-(p-toluenesulfonamido)diphenylamine, 4-isopropoxydiphenylamine, t-octylated N-phenyl-1-naphthylamine, mixtures of mono- and dialkylated t-butyl-t-octyldiphenylamines.

The following are exemplary of preferred secondary diarylamines that are commercially available from Ciba Corporation: Irganox® L67, Irganox L57, and Irganox L06.

The following are exemplary of more preferred secondary diarylamines that are commercially available from Crompton Corporation: Naugalube® 438, Naugalube 438L, Naugalube 640, Naugalube 635, Naugalube 680, Naugalube AMS, Naugalube APAN, and Naugard PANA.

Examples of some of the substituted para-phenylenediamines represented by the general formula (II) that are useful in the practice of this invention include: N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N'-di-(naphthyl-2)-p-phenylenediamines, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N-cyclohexyl-N'-phenyl-p-phenylenediamine.

The following are exemplary of preferred substituted para-phenylenediamines that are commercially available from Flexsys Corporation: Santoflex® IPPD, Santoflex 6PPD, Santoflex 44PD, Santoflex 77PD, Santoflex 134PD, Santoflex 1350PD, Santoflex 715PD, and Santoflex 434PD.

The following are exemplary of more preferred substituted para-phenylenediamines that are commercially available from Crompton Corporation: Flexzone® 4L, Flexzone 6H, Flexzone 7L, Flexzone 11L, Flexzone 12L, Flexzone 15L, Naugalube 403, Naugalube 410, and Naugalube 420.

With wide variation in the composition of the hydrocarbyl moieties, the optional substituted phenolic antioxidants represented by the formula (III) useful in the practice of this invention may include alkylated mono-phenols, alkylated hydroquinones, hydroxylated thiodiphenyl ethers, alkylidenebisphenols; acylaminophenols; and esters and amides of hindered phenol-substituted alkanoic acids.

The following are examples of such phenolic antioxidants: 2,6-di-tert-butyl-4-methylphenol, 2,6-di-tert-butylphenol, 2-tert-butyl-4,6-dimethylphenol, 2,6-di-tertbutyl-4-ethylphenol, 2,6-di-tert-butyl-4-isobutylphenol, 2,6-bis(alpha-methylbenzyl)-4-methylphenol, 2-alpha-methylbenzyl-4-methylphenol, 2,4,6,-tricyclohexylphenol, 2,6-di-tert-butyl-4-methoxymethylphenol and the like; 2,5-di-tert-butylhydroquinone, 2,5-di-tert-amyl-hydroquinone and the like; 2,2'-thiobis(6-tert-butyl-4-methylphenol), 2,2'-thiobis(4-octylphenol), 4,4'-thiobis(6-tert-butyl-3-methylphenol), 4,4'-thiobis(6-t-butyl-2-methylphenol) and the like; 2,2'-methylenebis(6-tert-butyl-4-methylphenol), 2,2'-methylenebis[4-methyl-6-(α-methylcyclohexyl)phenol], 2,2'-methylenebis(4-methyl-6-cyclohexylphenol), 2,2'-methylenebis(4,6-di-tert-butylphenol), 4,4'-methylenebis(2,6-di-tert-butylphenol), 1,1-bis(5-tert-butyl-4-hydroxy-2-methylphenyl)butane, di(3-tert-butyl-4-hydroxy-5-methylphenyl)dicyclopentadiene, ethylene glycol bis[3,3-bis(3'-tert-butyl-4'-hydroxylphenyl)butyrate] and the like; 1,3,5-tris(3,5-di-tert-butyl-4-hydroxybenzyl)-2,4,6-trimethyl-benzene, di(3,5-di-tert-butyl-4-hydroxybenzyl)sulfide, 3,5-di-tert-butyl-4-hydroxybenzylmercaptoacetic acid isooctyl ester, 3,5-di-tert-butyl-4-hydroxybenzylphosphonic acid dioctadecyl ester, 1,3,5-tris(3,5-di-tertbutyl-4-hydroxybenzyl)-isocyanurate, 1,3,5-tris(4-tertbutyl-3-hydroxy-2,6-dimethylbenzyl)-isocyanurate, bis(4-tert-butyl-3-hydroxy-2,6-dimethylbenzyl)dithioterephthalate, 3,5-di-tert-butyl-4-hydroxybenzylphosphonic acid mono-ethyl ester calcium salt and the like; 4-hydroxylauric acid anilide, 4-hydroxystearic acid anilide, 2,4-bis-octylmercapto-6-(3,5-di-tert-butyl-4-hydroxyaniline)-s-triazine, N-(3,5-di-tert-butyl-4-hydroxyphenyl)carbamic acid octyl ester and the like; 3,5-di-tert-butyl-4-hydroxybenzene-3-propionic acid esterified with methanol, octanol, octadecanol, 1,6-hyxanediol, neopentyl glycol, thiodiethylene glycol, diethylene glycol, triethylene glycol, pentaerythritol, and the like.

The following are exemplary of suitable phenolic antioxidants for the practice of this invention that are commercially available from Ciba Corporation: Irganox L101, Irganox L107, Irganox L109, Irganox L115, Irganox L118, and Irganox E201; and from Crompton Corporation: Naugard® BHT, Naugard SP, Naugard 529, Naugawhite®, Naugard 76, Antioxidant 431 and Naugalube 531.

In the preparation of the lubricating oil compositions of the present invention, the component (B), the secondary diarylamine selected from the group with the above general formula (I) and the component (C), the substituted para-phenylenediamine with the above general formula (II) can be blended in the compositions in a range of from about 0.01 to about 10 weight percent each, preferably from about 0.1 to about 5 weight percent. The optional component (D), the substituted phenol selected from the group with the general formula (III), can also be blended in the lubricating oil compositions in a range of from about 0.01 to about 10 total weight percent, preferably from about 0.1 to about 5 weight percent. The content ratio of the secondary diarylamine to the substituted para-phenylenediamine employed in the lubricating oil compositions of the present invention can be in practically all proportions. But, preferably, the ratio will be in the range of 1:99 to 99:1 parts by weight, more preferably, 90:10 to 10:90 parts by weight. In the event of inclusion of the optional substituted phenol, the content ratio of the three antioxidants can be in practically all proportions provided that the content ratio of the secondary diarylamine to the substituted para-phenylenediamine is within the range of 1:99 to 99:1 parts by weight, more preferably, 90:10 to 10:90 parts by weight.

The components of the present invention can be pre-mixed according to the content ratio just defined then added to, or can be separately added to, the lubricant with the aid of mild heating (50° C.) and mechanical agitation as needed.

The antioxidant mixtures of the present invention can be used in combination with other additives typically found in lubricating oils, as well as other antioxidants. The additives typically found in lubricating oils are, for example, dispersants, detergents, antiwear agents, antioxidants, friction modifiers, seal swell agents, demulsifiers, VI (viscosity index) improvers, pour point depressants, antifoamants, corrosion inhibitors, and metal deactivators. Such additives are well known to those skilled in the art and there is no particular restriction on the type of these additives for this invention. U.S. Pat. No. 5,498,809, incorporated herein by reference, discloses useful lubricating oil composition additives.

Examples of dispersants include polyisobutylene succinimides, polyisobutylene succinate esters, Mannich Base ashless dispersants, and the like. Examples of detergents include metallic and ashless alkyl phenates, metallic and ashless sulfurized alkyl phenates, metallic and ashless alkyl sulfonates, metallic and ashless alkyl salicylates, metallic and ashless saligenin derivatives, and the like.

Examples of antioxidants that can be used in combination with the antioxidant mixtures of the present invention include dimethyl quinolines, trimethyldihydroquinolines and oligomeric compositions derived therefrom, thiopropionates, metallic dithiocarbamates, oil soluble copper compounds, and the like. Examples of anti-wear additives that can be used in combination with the additives of the present invention include organoborates, organophosphites, organophosphates, organic sulfur-containing compounds, sulfurized olefins, sulfurized fatty acid derivatives (esters), chlorinated paraffins, zinc dialkyldithiophosphates, zinc diaryldithiophosphates, dialkyldithiophosphate esters, diaryl dithiophosphate esters, phosphosulfurized hydrocarbons, and the like. The following are exemplary of such additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others; from Ciba Corporation: Irgalube® 62, Irgalube 211, Irgalube 232, Irgalube 349, Irgalube 353, Irgalube TPPT, Irgafos® OPH, among others; and from Crompton Corporation: Weston® 600, Weston DLP, Weston TPP, among others.

Examples of friction modifiers include fatty acid esters and amides, organo molybdenum compounds, molybdenum dialkyldithiocarbamates, molybdenum dialkyl dithiophosphates, molybdenum disulfide, tri-molybdenum cluster dialkyldithiocarbamates, non-sulfur molybdenum compounds and the like. The following are exemplary of molybdenum additives and are commercially available from R. T. Vanderbilt Company, Inc.: Molyvan A, Molyvan L, Molyvan 807, Molyvan 856B, Molyvan 822, Molyvan 855, among others. The following are also exemplary of such additives and are commercially available from Asahi Denka Kogyo K.K.: SAKURA-LUBE 100, SAKURA-LUBE 165, SAKURA-LUBE 300, SAKURA-LUBE 310G, SAKURA-LUBE 321, SAKURA-LUBE 474, SAKURA-LUBE 600, SAKURA-LUBE 700, among others. The following are also exemplary of such additives and are commercially available from Akzo Nobel Chemicals GmbH: Ketjen-Ox 77M, Ketjen-Ox 77TS, among others. Naugalube MolyFM is also exemplary of such additives and is commercially available from Crompton Corporation.

Examples of VI improvers include olefin copolymers and dispersant olefin copolymers, and the like. An example of a pour point depressant is polymethacrylate, and the like. An example of an antifoamant is polysiloxane, and the like. Examples of rust inhibitors are polyoxyalkylene polyol, benzotriazole derivatives, and the like. Examples of metal deactivators include triazole, benzotriazole, 2-mercaptobenzothiazole, 2,5-dimercaptothiadiazole, tolyltriazole derivatives, N,N'-disalicylidene-1,2-diaminopropane, and the like. The following are exemplary of metal deactivators and are commercially available from Ciba Corporation: Irgamet® 30, Irgamet 39, and Irgamet 42.

Lubricant Compositions

Compositions, when they contain these additives, are typically blended into the base oil in amounts such that the additives therein are effective to provide their normal attendant functions. Representative effective amounts of such additives are illustrated in Table 1.

TABLE 1

| Additives | Preferred Weight % | More Preferred Weight % |
|---|---|---|
| V.I. Improver | 1-12 | 1-4 |
| Corrosion Inhibitor | 0.01-3 | 0.01-1.5 |
| Antioxidant | 0.01-5 | 0.01-1.5 |
| Dispersant | 0.1-10 | 0.1-5 |
| Lube Oil Flow Improver | 0.01-2 | 0.01-1.5 |
| Detergent/Rust Inhibitor | 0.01-6 | 0.01-3 |
| Pour Point Depressant | 0.01-1.5 | 0.01-0.5 |
| Anti-foaming Agents | 0.001-0.1 | 0.001-0.01 |
| Anti-wear Agents | 0.001-5 | 0.001-1.5 |
| Seal Swell Agents | 0.1-8 | 0.1-4 |
| Friction Modifiers | 0.01-3 | 0.01-1.5 |
| Lubricating Base Oil | Balance | Balance |

When other additives are employed, it may be desirable, although not necessary, to prepare additive concentrates comprising concentrated solutions or dispersions of the subject additives of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt.

The lubricating oil base stock can be derived from natural lubricating oils, synthetic lubricating oils, or mixtures thereof. Suitable lubricating oil base stocks include base stocks obtained by isomerization of synthetic wax and wax, as well as hydrocracked base stocks produced by hydrocracking (rather than solvent extracting) the aromatic and polar components of the crude. Natural lubricating oils include animal oils, such as lard oil, tallow oil, vegetable oils (e.g., canola oils, castor oils, sunflower oils), petroleum oils, mineral oils, and oils derived from coal or shale.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc.

Another suitable class of synthetic lubricating oils comprises the esters of dicarboxylic acids with a variety of alcohols. Esters useful as synthetic oils also include those made from $C_5$ to $C_{18}$ monocarboxylic acids and polyols and polyol ethers. Other esters useful as synthetic oils include those made from copolymers of α-olefins and dicarboxylic acids which are esterified with short or medium chain length alcohols.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly α-olefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a VI of at least 130, preferably at least 135 or higher and, following dewaxing, a pour point of about −20° C. or lower.

The lubricating oil used in the practice of the present invention can be selected from any of the base oils in Groups I-V as broadly specified in the American Petroleum Institute (API) Base Oil Interchangeability Guidelines. The five base oil groups are described in Table 2.

TABLE 2

| API Base Oil Category | Sulfur (%) | | Saturates (%) | Viscosity Index |
|---|---|---|---|---|
| Group I | >0.03 | and/or | <90 | 80 to 120 |
| Group II | ≦0.03 | and | ≧90 | 80 to 120 |
| Group III | ≦0.03 | and | ≧90 | ≧120 |
| Group IV | All polyalphaolefins (PAOs) | | | |
| Group V | All others not included in Groups I, II, III or IV | | | |

The additives of the present invention are especially useful as components in many different lubricating oil compositions. The additives can be included in a variety of oils with lubricating viscosity, including natural and synthetic lubricating oils and mixtures thereof. The additives can be included in crankcase lubricating oils for spark-ignited and compression-ignited internal combustion engines. The compositions can also be used in gas engine lubricants, steam and gas turbine lubricants, automatic transmission fluids, gear lubricants, compressor lubricants, metal-working lubricants, hydraulic fluids, and other lubricating oil and grease compositions. The additives can also be used to stabilize motor fuel compositions.

The advantages and the important features of the present invention will be demonstrated in the following examples.

EXAMPLES

The synergistic effects from combined usage of the paraphenylenediamine and the secondary diarylamine according to the practice of this invention has been demonstrated in an engine oil formulation by the following two accelerated oxidation tests: pressurized differential scanning calorimetry (PDSC), and the Mid-High Temperature Thermo-oxidation Engine Oil Simulation Test (TEOST) MHT.

The engine oil formulation used in the tests contained the following components that are commercially available. There is no particular restriction on the type and exact composition of the materials in the context of the present invention.

| Composition | Amounts, wt % |
|---|---|
| Base oil, Group II | 85 |
| Overbased sulfonate detergents | 2.5 |
| Antiwear/EP agent | 1.0 |
| Succinimide dispersant | 6.5 |
| VI improver | 5.0 |

Pressurized Differential Scanning Calorimetry Results

The Pressurized Differential Scanning Calorimetry (PDSC) measured the oxidation induction time (OIT) of each blend in Table 4. The PDSC instrument used is a Mettler DSC27HP, manufactured by Mettler-Toledo, Inc (Switzerland). The PDSC method employs a steel cell under constant oxygen pressure throughout each run. The instrument has a typical repeatability of ±2.5 minutes with 95 percent confidence over an OIT of 100 minutes. The PDSC test conditions are given in Table 3. At the beginning of a PDSC run, the steel cell is pressurized with oxygen and heated at a rate of 40° C. per minute to the prescribed isothermal temperature. The induction time is measured from the time the sample reaches its isothermal temperature until the enthalpy change is observed. The longer the oxidation induction time, the better the oxidation stability of the oil.

TABLE 3

PDSC Test Conditions

| Test Parameters | Settings |
|---|---|
| Isothermal Temperature | 200° C. |
| $O_2$ Gas Pressure | 500 psi |
| $O_2$ Gas Flow Rate Through Cell | 100 ml/min. |
| Catalyst | 50 ppm of Iron |
| Sample Holder | Open Aluminum Pan |
| Sample size | 1.0-2.0 mg |
| Induction Time | Enthalpy Change |

The secondary diarylamine used in the test was a complex mixture of predominantly mono-, di- and tri-nonyl diphenyl amines and is currently sold under the trade designation Naugalube 438L, while the substituted para-phenylenediamine used in the test was a blend of N-(hexyl/heptyl)-N'-phenyl-para-phenylenediamines currently sold under the trade designation Naugalube 420, both being commercially available from Crompton Corporation. The total amount of added antioxidants including the secondary diarylamine and the substituted para-phenylenediamine according to the practice of this invention was 1.5 weight percent in each blend. All test blends were mechanically mixed for 15 minutes under a nitrogen atmosphere. For every 50 grams of test blend prepared, 40 μL of oil soluble ferric naphthenate (6 weight percent in mineral oil) was added, prior to PDSC testing, to facilitate 50 ppm of iron in the oil. Each blend was tested twice under the PDSC conditions described in Table 3 at 200° C. The average and standard deviation of each duplicate run are given in Table 4. The OIT results of blends 3, 4, and 5 in the data table demonstrate that the lubricating oil compositions containing appropriate mixtures of the antioxidant mixtures according to the present invention have superior oxidative stabilities.

TABLE 4

PDSC Results

| Blend | Antioxidant (wt %) | Antioxidant (wt %) | OIT, min | SD, min |
|---|---|---|---|---|
| 1 | Naugalube ® 420 (1.50) | — | 31.3 | 0.0 |
| 2 | — | Naugalube 438L (1.50) | 32.1 | 0.5 |
| 3 | Naugalube 420 (0.75) | Naugalube 438L (0.75) | 36.3 | 1.2 |
| 4 | Naugalube 420 (1.00) | Naugalube 438L (0.50) | 36.4 | 0.7 |
| 5 | Naugalube 420 (0.50) | Naugalube 438L (1.00) | 35.1 | 0.3 |

Thermo-Oxidation Engine Oil Simulation Test (TEOST) MHT

The synergistic effects of the mixtures of the secondary diarylamine and substituted para-phenylenediamine in stabilizing the engine oil formulation have been more clearly demonstrated by the Mid-High Temperature Thermo-oxidation Engine Oil Simulation Test (TEOST) MHT, which determines the mass of a deposit formed on a specially constructed steel rod by continuously stressing a repetitive passage of 8.5 of test oil under thermal-oxidative and catalytic conditions. The instrument used was manufactured by Tannas Co. and has a typical repeatability of 0.15(x+16) mg wherein x is the mean of two or more repeated test results. The TEOST test conditions are listed in Table 5. The lower the amount of deposits obtained, the better the oxidation stability of the oil.

The secondary diarylamine used in the test was a complex mixture of predominantly mono-, di- and tri-nonyl diphenyl amines currently sold under the trade designation Naugalube 438L, while the substituted para-phenylenediamine used in the test was a blend of N-(hexyl/heptyl)-N'-phenyl-para-phenylenediamines currently sold under the trade designation Naugalube 420, both being commercially available from Crompton Corporation. The total amount of added antioxidants including the secondary diarylamine and the substituted para-phenylenediamine according to the practice of this invention was 1.5 weight percent in each blend. The significantly lower amounts of deposits obtained for blends 8, 9, and 10, as shown in the data in Table 6, demonstrate that the lubricating oil compositions containing appropriate mixtures of the antioxidant blends of the present invention have superior oxidative stabilities to produce smaller amounts of deposits in the TEOST.

TABLE 5

TEOST MHT Test Conditions

| Test Parameters | Settings |
|---|---|
| Test duration | 24 hours |
| Rod Temperature | 285° C. |
| Sample size | 8.5 g (mixture of 8.4 g of oil and 0.1 g of catalyst) |
| Sample flow rate | 0.25 g/min |
| Flow rate (dry air) | 10 mL/min |
| Catalyst | Oil soluble mixture containing Fe, Pb, and Sn |

TABLE 6

| Blend | Antioxidant (wt %) | Antioxidant (wt %) | Deposits, mg |
|---|---|---|---|
| | TEOST Results | | |
| 6 | Naugalube ® 420 (1.50) | — | 15.3 |
| 7 | — | Naugalube 438L (1.50) | 20.7 |
| 8 | Naugalube 420 (0.75) | Naugalube 438L (0.75) | 8.9 |
| 9 | Naugalube 420 (1.00) | Naugalube 438L (0.50) | 9.8 |
| 10 | Naugalube 420 (0.50) | Naugalube 438L (1.00) | 4.7 |

In view of the many changes and modifications that can be made without departing from principles underlying the present invention, reference should be made to the appended claims for an understanding of the scope of the protection to be afforded the invention.

What is claimed is:

1. A lubricant composition comprising:

(A) at least one lubricating oil selected from the group consisting of natural and synthetic lubricating base oils;

(B) from 0.5 weight percent to 1.0 weight percent, based on the total weight of the composition, of a mixture of mono-, di-, and tri-nonylated diphenyl amines; and (C) from 0.5 weight percent to 1.0 weight percent, based on the total weight of the composition, of a blend of N-(hexyl/heptyl)-N'-phenyl-para-phenylenediamine.

2. The composition of claim 1 further comprising at least one additional additive selected from the group consisting of dispersants, detergents, rust inhibitors, antioxidants, metal deactivators, antiwear agents, antifoamants, friction modifiers, seal swell agents, demulsifiers, viscosity index improvers, and pour point depressants.

3. A fuel composition comprising:

(A) at least one motor fuel;

(B) from 0.5 weight percent to 1.0 weight percent, based on the total weight of the composition, of a mixture of mono-, di-, and tri-nonylated diphenyl amines; and (C) from 0.5 weight percent to 1.0 weight percent, based on the total weight of the composition, of a blend of N-(hexyl/heptyl)-N'-phenyl-para-phenylenediamine.

4. A method of increasing the oxidation stability of a lubricant comprising adding to said lubricant (A) from 0.5 weight percent to 1.0 weight percent, based on the total weight of the composition, of a mixture of mono-, di- and tri-nonylated diphenyl amines; and (B) from 0.5 weight percent to 1.0 weight percent, based on the total weight of the composition, of a blend of N-(hexyl/heptyl)-N'-phenyl-para-phenylenediamine.

5. The method of claim 4 wherein the composition further comprises at least one additional additive selected from the group consisting of dispersants, detergents, rust inhibitors, antioxidants, metal deactivators, antiwear agents, antifoamants, friction modifiers, seal swell agents, demulsifiers, viscosity index improvers, and pour point depressants.

6. A method of increasing the oxidation stability of a motor fuel comprising adding to said motor fuel:

(A) from 0.5 weight percent to 1.0 weight percent, based on the total weight of the composition, of a mixture of mono-, di-, and tri-nonylated diphenyl amines; and (B) from 0.5 weight percent to 1.0 weight percent, based on the total weight of the composition, of a blend of N-(hexyl/heptyl)-N'-phenyl-para-phenylenediamine.

* * * * *